US009912077B2

(12) United States Patent
Peng

(10) Patent No.: US 9,912,077 B2
(45) Date of Patent: Mar. 6, 2018

(54) BROADBAND POLARIZATION DIVERSITY ANTENNAS

(71) Applicant: Farfield Co., Bellevue, WA (US)

(72) Inventor: Sheng Yeng Peng, Lynnwood, WA (US)

(73) Assignee: WavCatcher, Inc., Grand Prairie, TX (US)

( * ) Notice: Subject to any disclaimer, the term of this patent is extended or adjusted under 35 U.S.C. 154(b) by 0 days.

(21) Appl. No.: 14/266,290

(22) Filed: Apr. 30, 2014

(65) Prior Publication Data

US 2014/0320362 A1 Oct. 30, 2014

Related U.S. Application Data

(60) Provisional application No. 61/817,756, filed on Apr. 30, 2013.

(51) Int. Cl.

| | |
|---|---|
| ***H01Q 1/28*** | (2006.01) |
| ***H01Q 11/10*** | (2006.01) |
| ***H01Q 21/24*** | (2006.01) |
| ***H01Q 3/26*** | (2006.01) |

(52) U.S. Cl.
CPC ..... *H01Q 21/24* (2013.01); *H01Q 3/26* (2013.01)

(58) Field of Classification Search
USPC ..... 343/792.5, 705
See application file for complete search history.

(56) References Cited

U.S. PATENT DOCUMENTS

| | | | | |
|---|---|---|---|---|
| 4,257,049 | A | 3/1981 | Kuo | |
| 4,656,482 | A * | 4/1987 | Peng | 343/705 |
| 5,519,408 | A * | 5/1996 | Schnetzer | 343/767 |
| 7,327,226 | B2 * | 2/2008 | Turnbull et al. | 340/425.5 |
| 2002/0024472 | A1 | 2/2002 | Thursby et al. | |
| 2005/0035911 | A1 | 2/2005 | Cheng et al. | |
| 2011/0025576 | A1 | 2/2011 | Mao et al. | |

* cited by examiner

*Primary Examiner* — Graham Smith
(74) *Attorney, Agent, or Firm* — Olympic Patent Works PLLC

(57) ABSTRACT

This disclosure is directed to broadband polarization diversity antennas. In one aspect, a polarization diversity antenna includes a baseboard with a baseboard-feed line located on a first surface. The baseboard-feed line includes a serpentine meander-line portion. The antenna also includes an antenna-array board with two or more antenna elements arranged in a series. The antenna-array board is attached to the first surface with the serpentine meander-line portion located between an edge of the antenna-array board and the baseboard. Each antenna element is connected to the serpentine meander-line portion via an antenna-feed line located on the antenna-array board. The antenna array provides two dimensional polarization broadcasting and receiving of electromagnetic radiation. In another aspect, a notch antenna is formed on an opposing second surface of the baseboard opposite the antenna-array board in order to provide three-dimensional polarization broadcasting and receiver of electromagnetic radiation.

20 Claims, 6 Drawing Sheets

BROADBAND POLARIZATION DIVERSITY ANTENNAS

CROSS-REFERENCE TO RELATED APPLICATION

This application claims the benefit of Provisional Application No. 61/817,756, filed Apr. 30, 2013.

TECHNICAL FIELD

The present disclosure is directed to antennas, and, in particular, to polarization antennas.

BACKGROUND

In recent years, the rapid development of a wide variety of wireless-communication devices has brought about a wave of new antenna technologies. Mobile phones and wireless networks are just a few examples of wireless, multiple frequency, and multi-mode devices that have driven the advancement of antenna technology. Antennas used in current and future wireless-communication devices are expected to have high gain, small physical size, broad bandwidth, versatility, low manufacturing cost, and are capable of embedded installation. These antennas are also expected to satisfy performance requirements over particular operating frequency ranges. For example, fixed-device antennas, such as cellular base-stations and wireless access points, should have high gain and stable radiation coverage over a selected operating frequency range. On the other hand, antennas for mobile wireless devices, such as mobile phones, tablets, and laptop computers, should be efficient in radiation and omni-directional coverage. These antennas are expected to provide impedance matching over selected operating frequency ranges.

However, many antennas that are currently used in wireless-communication devices satisfy the embedded installation and low cost manufacturing requirements but have limited bandwidths. Researchers and engineers in the wireless-communications industry seek antennas that are low cost and capable of embedded installation, but are also able to receive and transmit over broad bandwidths for multiple frequency or multi-mode wireless communication devices and systems.

SUMMARY

This disclosure is directed to broadband polarization diversity antennas. In one aspect, an antenna is formed from a baseboard and an antenna-array board. The baseboard has a baseboard-feed line with a serpentine meander-line portion located on a first surface. The antenna-array board has two or more antenna elements arranged in a series. The antenna-array board is attached to the first surface of the baseboard with the serpentine meander-line portion located between an edge of the antenna-array board and the baseboard. Each antenna element is connected to the serpentine meander-line portion via an antenna-feed line located on the antenna-array board. The antenna array provides two dimensional polarization broadcasting and receiving of electromagnetic radiation. In another aspect, a notch antenna is formed on an opposing second surface of the baseboard opposite the antenna-array board in order to provide three-dimensional polarization broadcasting and receiver of electromagnetic radiation. The antenna-array board and baseboard may be shaped to fit within a variety of different spaces including, but not limited to, a wing of an aircraft, a mobile device, or a missile.

DETAILED DESCRIPTION

Figure 1:
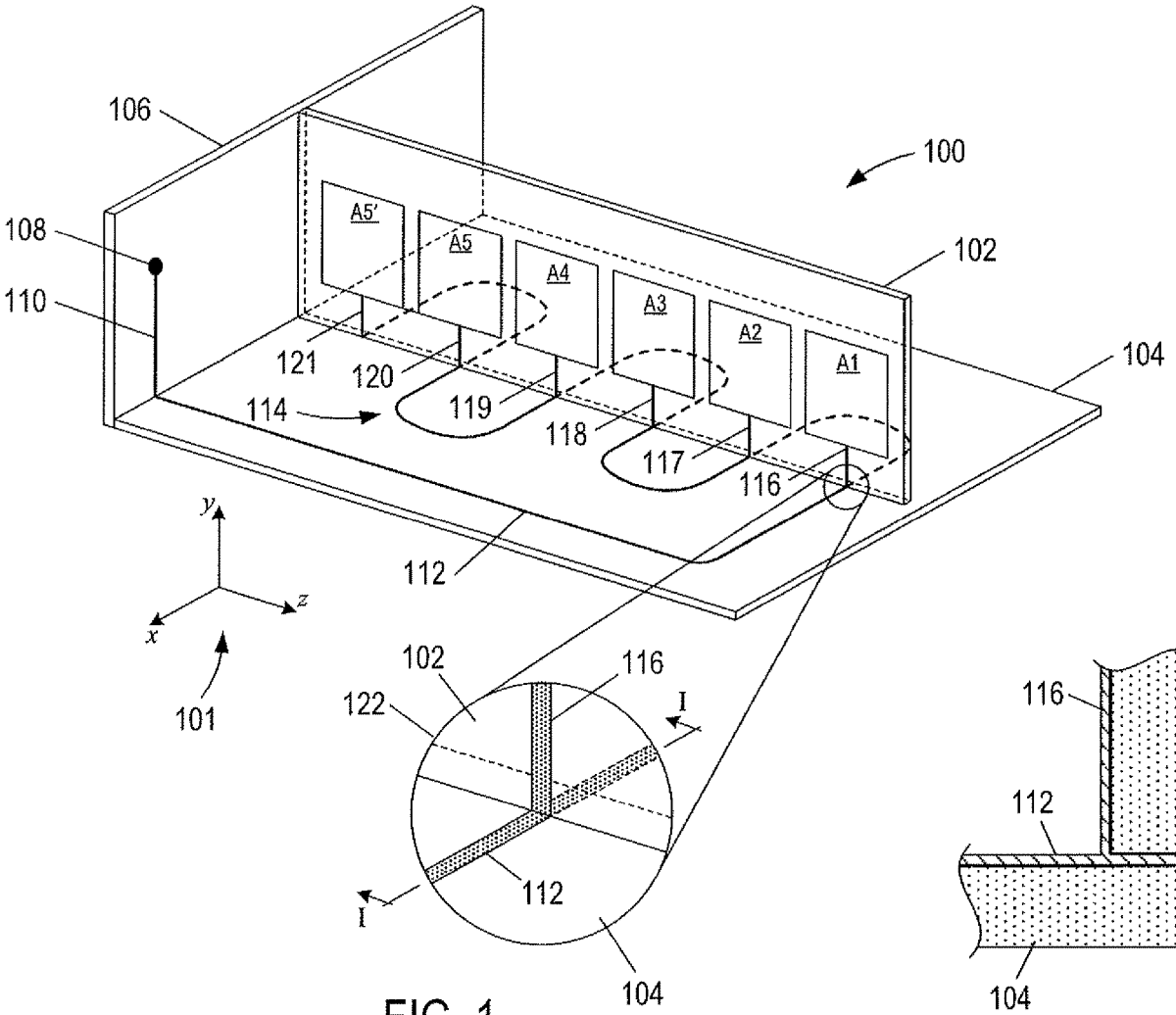
FIG. 1 shows an isometric view of an example polarization diversity antenna.

FIG. 1 shows an isometric view of an example polarization diversity antenna 100. FIG. 1A includes a Cartesian coordinate system 101 with three orthogonal spatial axes labeled x, y and z. The coordinate system 101 is included in FIG. 1A and in subsequent figures to specify different views of polarization diversity antenna components. As shown in FIG. 1, the antenna 100 includes an antenna-array board 102 attached along an edge to a baseboard 104 and along an orthogonal edge to a backboard 106. The boards 102, 104, and 106 are assemble with the planes of the boards 102, 104, and 106 oriented at nearly right angles to one another to form the antenna 100. In this example, an input port 108 and backboard-feed line 110 are located on a surface of the backboard 106. The backboard-feed line 110 is in turn connected to a baseboard-feed line 112 located on a surface of the baseboard 104. The baseboard-feed line 112 includes a sinusoidal or serpentine meander-line portion 114 that crosses back and forth along the surface of the baseboard 104 and between the edge of the antenna board 102 connected to the baseboard 104. In this example, the antenna board 102 includes six antenna elements, denoted by A1, A2, A3, A4, A5, and A5', arranged in a series along the same surface of the antenna board 102. The antenna elements A1, A2, A3, A4, A5, and A5' are connected to the meander-line portion 114 by separate antenna-feed lines 116-121. For example, FIG. 1 includes a magnified view 122 of the antenna-feed line 116 connected to the baseboard-feed line 112.

Figure 2:
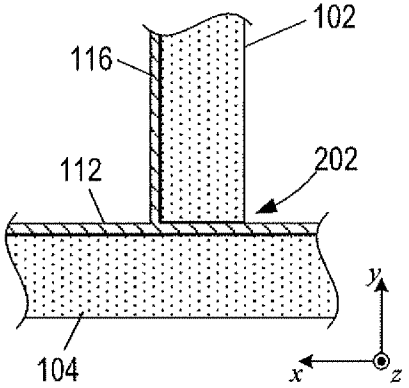
FIG. 2 shows a cross-sectional view of an antenna-feed line connected to a baseboard-feed line along a line I-I shown in FIG. 1.

FIG. 2 shows a cross-sectional view of the antenna-feed line 116 connected to the baseboard-feed line 112 along a line I-I shown in FIG. 1. As shown in the example of FIG. 2, the plane of the antenna board 102 is positioned substantially perpendicular to the plane of the baseboard 104. The antenna board 102 includes a notch 202 along the edge that faces the baseboard 102 that allows the baseboard-feed line 112 to pass underneath the antenna board 102. The edges of boards 102, 104, and 106 may be attached as shown in FIG. 1 with an adhesive or may be soldered or welded together.

The input port 108, feed lines 110, 112, 116-121, and antenna elements A1, A2, A3, A4, A5, and A5' are electronic components composed of conductive materials, such as copper, aluminum, silver, gold, and platinum. The boards 102, 104, and 106 upon which the electrically components are located on are composed of dielectric or non-conductive materials including, but not limited to, FR-4, laminate, plastic, fiberglass, polyester film such as polyethylene terephthalate, polyimide, wood, or paper. The electronic components are printed on the boards using any one of many different printed circuit board manufacturing techniques, such as panelization, copper patterning, silk screen printing, photoengraving, and printed circuit board milling.

Figure 3:
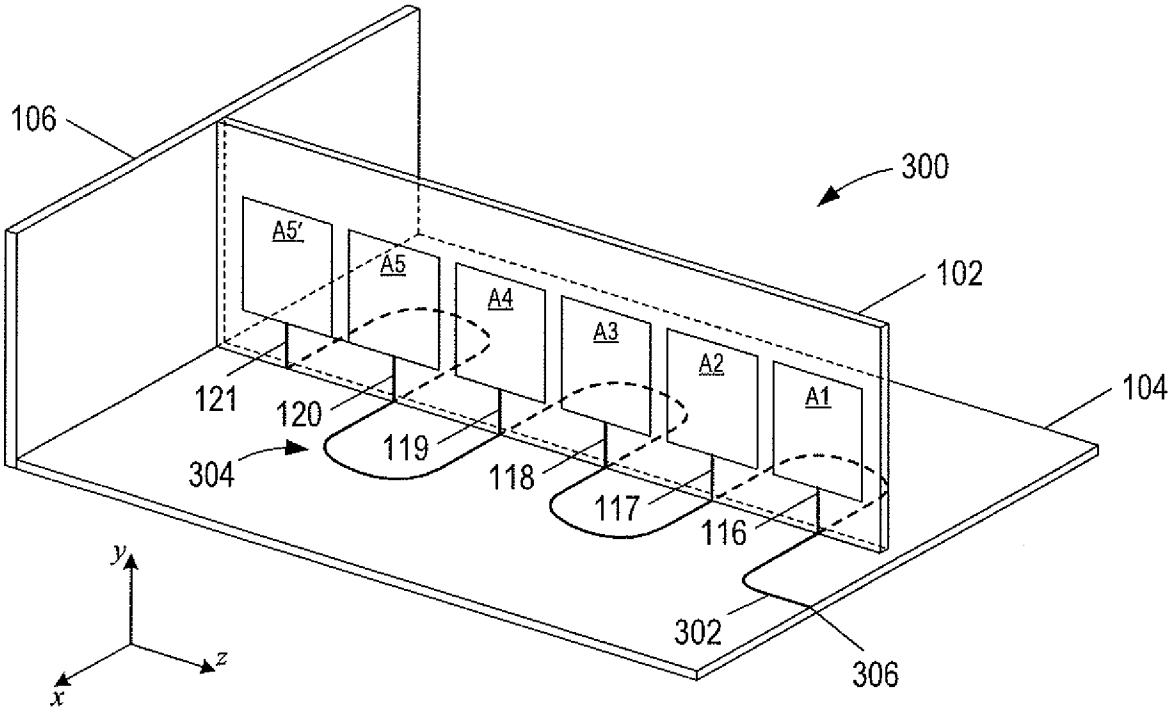
FIG. 3 shows an isometric view of an example polarization diversity antenna.

In other implementations, the input port 108 and backboard-feed line 110 may be omitted and a baseboard may be configured with a baseboard-feed line that terminates at an edge of the baseboard. FIG. 3 shows an isometric view of an example polarization diversity broadband antenna 300. The antenna 300 is similar to the broadband antenna 100, but instead of having a baseboard-feed line connected to a backboard-feed line as shown in FIG. 1, the antenna 300 has a baseboard-feed line 302 that includes a sinusoidal meander line portion 304 and a terminal 306 located along an edge of the baseboard 104. The baseboard-feed line 302 is connected to the antenna-feed lines 116-121 as described above with reference to FIGS. 1 and 2.

For the sake of convenience and brevity, polarization diversity antennas are described below with reference to the example polarization diversity antenna 100. However, polarization diversity antennas are not intended to be limited to just six antenna elements. Polarization diversity antennas may be implemented with any number of antenna elements from as few as two antenna elements to more than six antenna elements.

In general, each antenna element Ai has an associated frequency denoted by $f_i$ the antenna element is configured to interact with. In other words, each antenna element Ai broadcasts and receives electromagnetic radiation with the associated frequency $f_i$ and frequencies in a frequency band around the frequency $f_i$. In practice, each antenna element Ai broadcasts and receives electromagnetic radiation over a frequency band centered at the associated frequency $f_i$. The frequency band is represented by $$f_i^{low} \le f_i \le f_i^{high} \quad (1)$$

where i is an integer antenna element index;

$f_i^{low}$ is the low frequency bound of the frequency band of antenna element Ai;

and $f_i^{high}$ is the high frequency bound of the frequency band of antenna element Ai.

The frequency bands may be narrow frequency bands or have a narrow frequency bandwidth given by $f_i^{high} - f_i^{low}$.

Figure 4A:
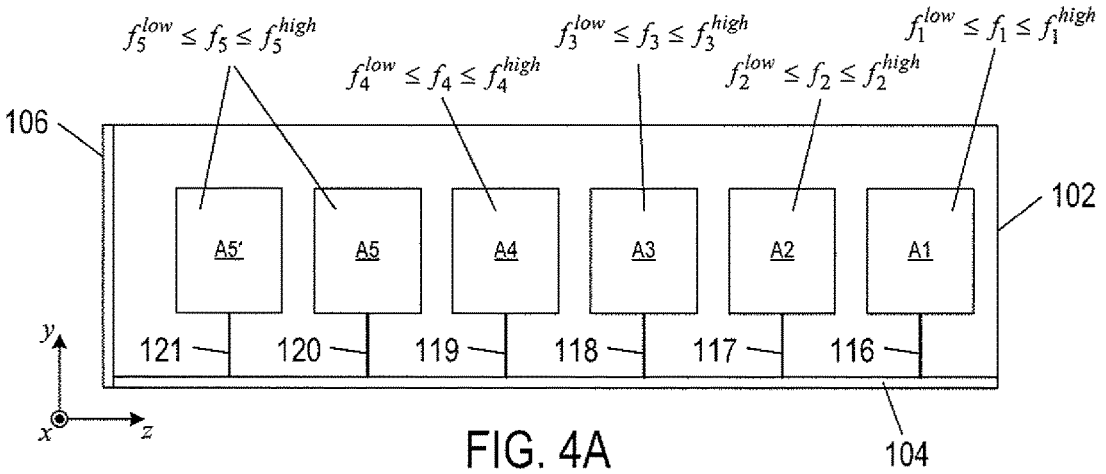
FIG. 4A shows a side-elevation view of the polarization diversity antenna shown in FIG. 1.

FIG. 4A shows a yz-plane view of the polarization diversity antenna 100. The antenna elements A1, A2, A3, A4, A5 are associated with the frequencies $f_1$, $f_2$, $f_3$, $f_4$ and $f_5$, respectively, and each antenna element is able to broadcast and receive electromagnetic radiation in a separate frequency band of the radio spectrum represented by Equation (1). Note that adjacent antenna elements A5 and A5' located closest to the backboard 106. The antenna element A5' is nearly identical to the antenna element A5 in that both elements are associated with the frequency $f_5$ and are able to broadcast and receive electromagnetic radiation in the same frequency band $f_5^{low} \le f_5 \le f_5^{high}$. The antenna elements A1, A2, A3, A4, A5, and A5' are configured and arranged so that the closer an antenna element is to the backboard 106 the lower the associated frequency. In other words, the frequencies associated with the antenna elements A1, A2, A3, A4, A5, and A5' increase the farther the antenna element is away from the backboard 106 (i.e., $f_1 > f_2 > f_3 > f_4 > f_5$). For example, antenna element A1 has the highest associated frequency $f_1$, antenna element A2 has the second highest associated frequency $f_2$, and so on with the antenna element A5 (and A5') having the lowest associated frequency $f_5$.

Figure 4B:
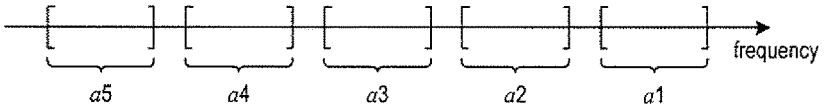
FIGS. 4B-4D show three examples of different frequency bands associated with antenna elements of polarization diversity antennas.
Figure 4C:
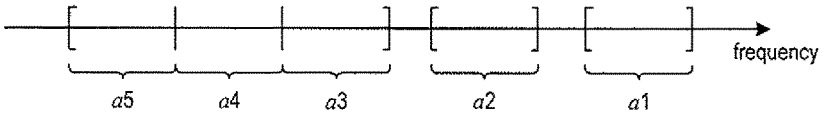
Figure 4D:
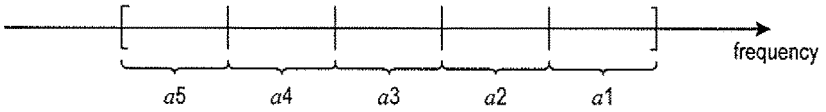

The antenna elements of an antenna-array board may be configured in certain implementations so that the associated frequency bands represented by Equation (1) are separate. In other implementations, the frequency bands associated with two or more antenna elements partition a larger frequency band. FIGS. 4B-4D show three examples of different ways the antenna elements in FIG. 4A may be configured to interact with different frequency bands of the radio frequency spectrum. The frequency bands associated with the antenna elements A1, A2, A3, A4, A5, and A5' are represented by bracketed subintervals and are corresponding labeled a1, a2, a3, a4, and a5 (i.e., $ai = f_i^{low} \le f_i \le f_i^{high}$, i=1, . . . , 5). As described above, the frequencies in the frequencies bands a1, a2, a3, a4, and a5 increase the farther the associated antenna element is from the backboard 106, and the antenna elements A5 and A5' use the same frequency band a5. In FIG. 4B, the frequency bands are separated from each other. In FIG. 4C, the frequency bands a1 and a2 are separated from each other and the other frequency bands and the frequency bands a3, a4, and a5 partition a larger frequency band. In FIG. 4D, the frequency bands a1, a2, a3, a4, and a5 partition a single larger frequency band.

The antenna elements of an antenna-array board may be collectively used to broadcast and receive electromagnetic radiation in a broadband of the radio spectrum of the electromagnetic spectrum. In particular, the antennas may be used to send and receive electromagnetic radiation in the Very High (i.e., about 30 MHz to about 300 MHz), Ultra High (i.e., about 300 MHz to about 3 GHz), and/or the Super High (i.e., about 3 GHz to about 300 GHz) frequency bands of the radio spectrum. For example, the antennas of the antenna 100 may be configured to interact with frequency bands in portions of the Very High and Ultra High frequency ranges from about 200 MHz and 2.0 GHz. A polarization diversity antenna with antenna elements that interact with frequency bands between a high frequency of about 2.0 GHz to low frequency of about 200 MHz is considered an ultra-broadband antenna.

Figure 5:
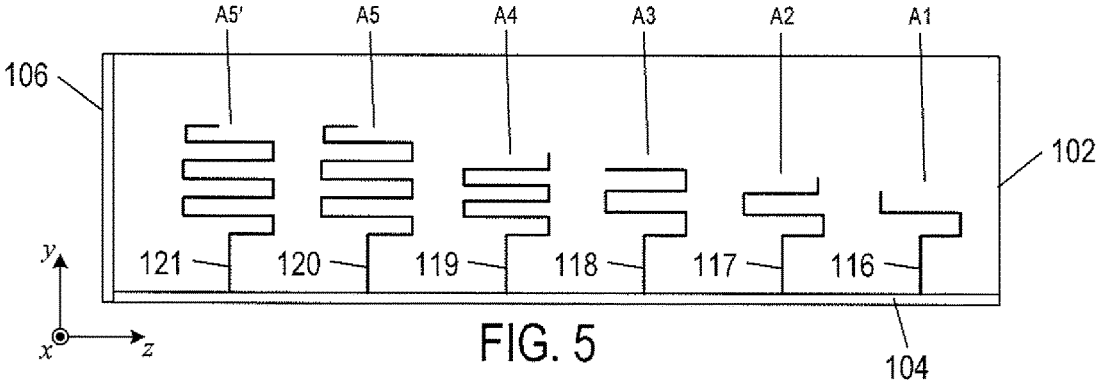
FIG. 5 shows an example of an antenna-array board with six meander-line antenna elements.

Antenna elements of an antenna-array board may be meander-line antenna elements. FIG. 5 shows an example of the antenna elements A1, A2, A3, A4, A5, and A5' configured as meander-line antenna elements. As shown in FIG. 5, the length of the meander-line antenna elements decreases the farther the meander-line elements are away from the backboard 106. The frequency band of a meander-line antenna element is determined by the length of the meander-line portion of the meander-line antenna element. For example, in FIG. 5, the meander-line antenna element A1 has the shortest meander-line segment while the meander-line antenna element A5 has the longest meander-line segment. As a result, the meander-line antenna element A1 interacts with higher frequencies of the radio spectrum than the meander-line antenna element A5.

Figure 6:
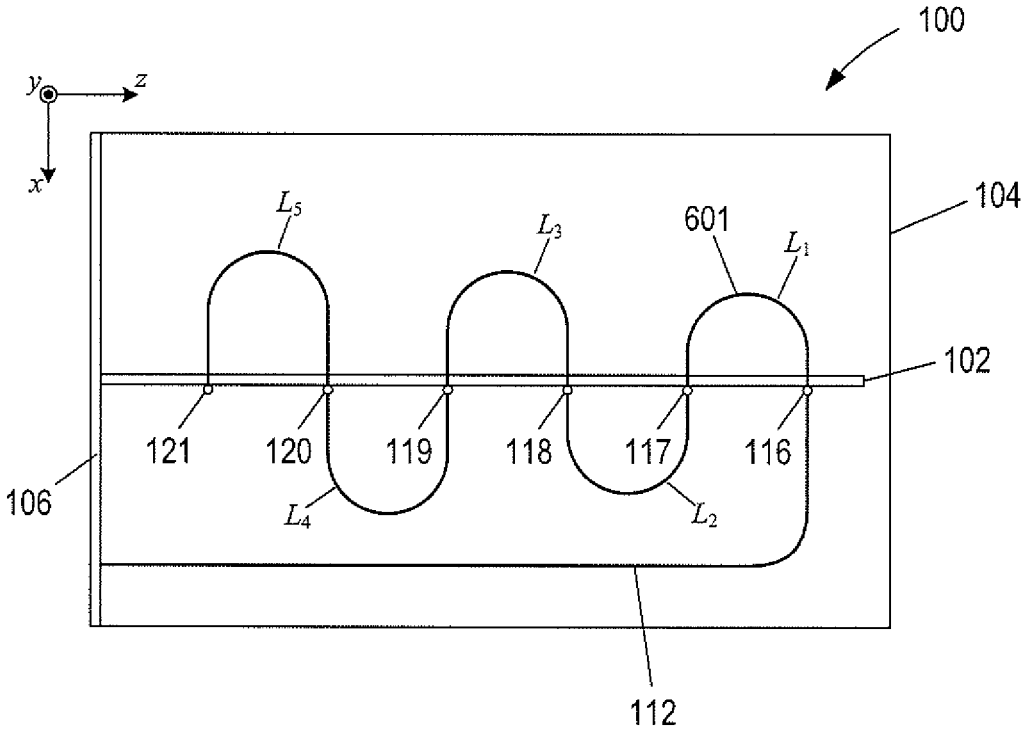
FIG. 6 shows a plane view of the polarization diversity antenna shown in FIG. 1.

Returning to FIG. 1, the length of each U-shaped segment of the serpentine portion of the baseboard-feed line 112 connected to adjacent antenna elements is determined by which of the two adjacent antenna elements interacts with the shorter wavelength or higher frequency of electromagnetic radiation. FIG. 6 shows an xz-plane view of the polarization diversity antenna 100. In the example of FIG. 6, small open circles represent the antenna-feed lines 116-121 that connect the baseboard-feed line 112 to corresponding antenna elements A1, A2, A3, A4, A5, and A5' (not shown) located on the antenna-array board 102. The lengths of the U-shaped meander-feed line segments that run between adjacent antenna-feed lines are denoted by $L_1$, $L_2$, $L_3$, $L_4$, and $L_5$. For example, $L_1$ represents the length of U-shaped, meander-feed line segment 601 that runs between antenna-feed lines 116 and 117. The length of each U-shaped meander-feed line segment is determined by which of the two connected antenna elements has the higher associated frequency (i.e., shorter wavelength). For example, U-shaped, meander-feed line segment 601 is connected to antenna-feed lines 116 and 117 which connect to antenna elements A1 and A2, respectively. As explained above, antenna element A1 has a higher frequency than antenna element A2 (i.e., $f_1>f_2$). As a result, the length $L_1$ of the U-shaped segment 601 is determined by the frequency $f_1$ of the antenna element A1.

In general, the length $L_i$ of each U-shaped meander-feed line segment is determined by $$L_i \approx \frac{1}{2}\lambda_{\epsilon,i} \tag{2}$$

where $\lambda_{\in,i}$ is the wavelength of electromagnetic radiation with frequency $f_i$ in the baseboard and antenna-array board. The wavelength $\lambda_{\in,i}$ is related to the frequencies $f_i$ by $$\lambda_{\epsilon,i} = \frac{\lambda_{air,i}}{\sqrt{\epsilon_r}} \tag{3}$$

where $\lambda_{air,i}$ is the wavelength of electromagnetic radiation with frequency $f_i$ interaction air; and $\in_r$ is the dielectric constant of the base and antenna-array boards.

Using Equations (2) and (3), the length $L_i$ of a U-shaped, meander-feed line segment that connects adjacent antenna elements Ai and Ai+1 with associated frequencies $f_i$ and $f_{i+1}$ is determined by $$L_i \approx \frac{v_{air}}{2\sqrt{\epsilon_r}\, f_i} \tag{4}$$

where $f_i>f_{i+1}$; and $$\lambda_{air,i} = \frac{v_{air}}{f_i}$$

with $v_{air}$ the speed of electromagnetic radiation in air.

In other words, the length of a meander-feed line segment is inversely proportional to the higher frequency of the two antenna elements connected to the meander-feed line segment.

Figure 7:
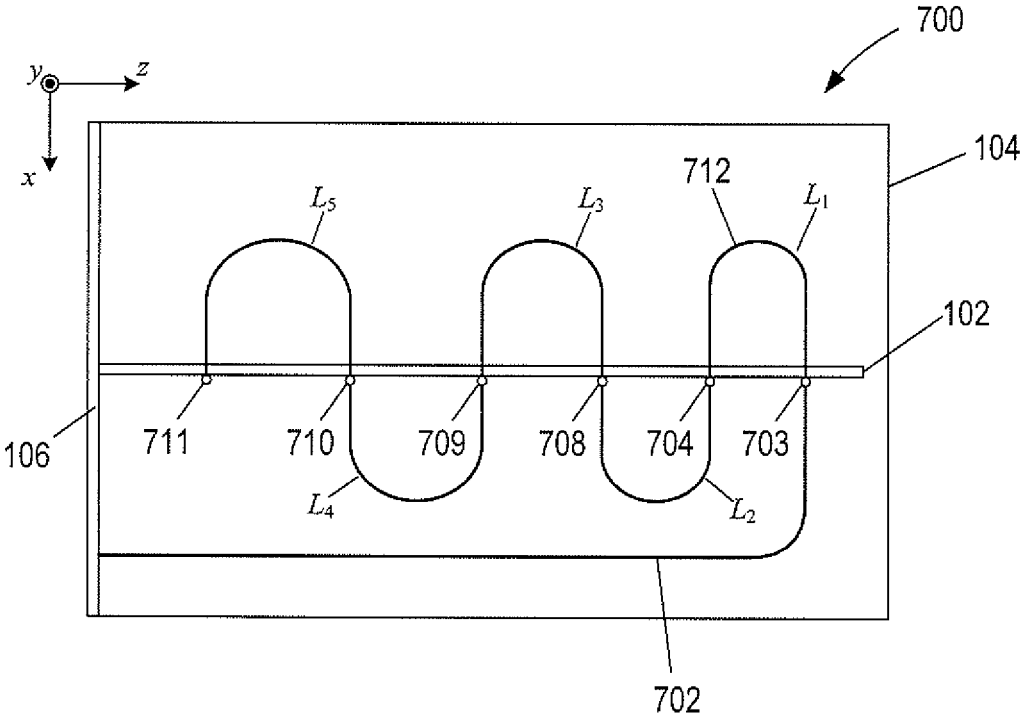
FIG. 7 shows a plane view of a polarization diversity antenna in which the distance between adjacent antenna elements decreases with the distance from a backboard.

Although FIGS. 1-6 illustrate an antenna-array board 102 with substantially evenly spaced apart antenna elements, the spacings between the antenna elements may vary or the spacings between adjacent antenna elements may increase or decrease with the distance from the backboard 106. FIG. 7 shows an xz-plane view of a polarization diversity antenna 700 in which the distance between adjacent antenna elements decreases with increased antenna-element distance from the backboard 106. The antenna 700 is similar to the antenna 100 shown in FIG. 6 in that a baseboard meander-feed line 702 located on baseboard 104 connects to six antenna-feed lines 703-711 that lead to antenna elements A1, A2, A3, A4, A5, and A5' (not shown) located on the antenna-array board 102. In this example, although the widths of the U-shaped segments narrow with increasing distance from the backboard 106, the length of U-shaped segments between adjacent antenna elements is the same as the U-shaped segments between antenna elements described above with reference to FIG. 6. For example, U-shaped segment 712 that connects to antenna-feed lines 703 and 704 is substantially the same as the U-shaped segment 601 in FIG. 6.

Figure 8:
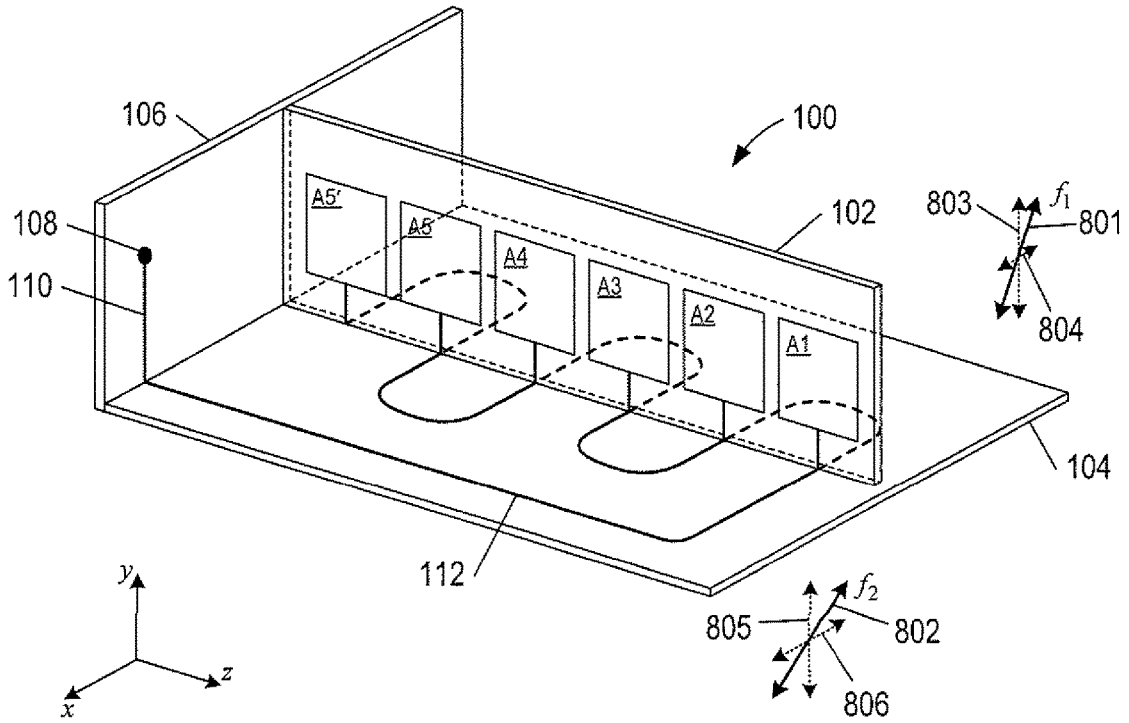
FIG. 8 shows interaction of a polarization diversity antenna with electromagnetic radiation of two different frequencies.

The polarization diversity antenna 100 can be used to receive electromagnetic radiation in a frequency band associated with any one of the antenna elements or used to broadcast electromagnetic radiation over the ranges of frequencies associated with the antenna elements. FIG. 8 shows interaction of the antenna 100 with electromagnetic radiation with a frequency $f_1$ and a frequency $f_2$. Double-headed directional arrow 801 represents polarization of the electromagnetic radiation with frequency $f_1$, and a double-headed directional arrow 802 represents polarization of the electromagnetic radiation with frequency $f_2$. The antenna element A1 interacts with the y- and z-polarization components 803 and 804 of the electromagnetic radiation, and the antenna element A2 interacts with the y- and z-polarization components 805 and 806 of the electromagnetic radiation. The antenna elements A1, A2, A3, A4, A5, and A5' do not interact with x-polarization components of the electromagnetic radiation.

Figure 9:
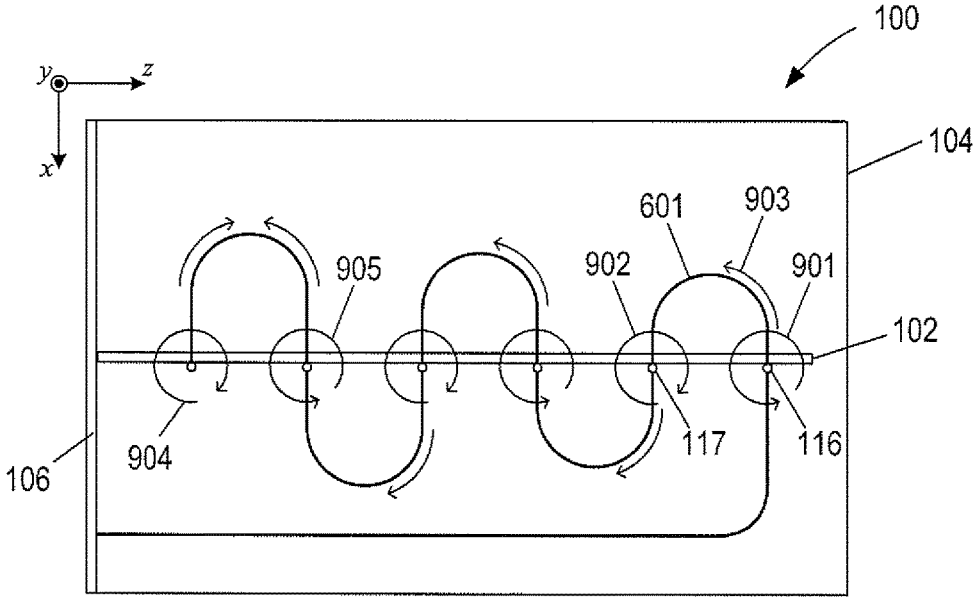
FIG. 9 illustrates phase reversal between adjacent antenna elements.

The antenna 100 use phase reversal between two adjacent antenna elements to increase antenna peak gain. FIG. 9 illustrates phase reversal between adjacent antenna elements. Circular direction arrows, such as circular directional arrows 901 and 902, illustrate phase reversal created by adjacent antenna elements. For example, consider electromagnetic radiation with a frequency $f_1$ that interacts with the antenna element A1 and has a phase direction represented by circular directional arrow 901. As a result, the antenna element A1 generates an electrical current that travels 903 along U-shape segment 601 to adjacent antenna element A2 to generate electromagnetic radiation that is approximately 180 degrees out of phase (i.e., phase reversal) represented by circular direction arrow 902. The result of this phase reversal is a net energy gain at the antenna element A1. In particular, the radiation of the antenna element A1 directed toward the backboard 106 is cancelled by the phase reversal, but the radiation output from the antenna element A2 and directed away from backboard 106 is added to the radiation output from antenna element A1 resulting in a net gain for the antenna element A1. As a result, the peak gain at each frequency associated with the antenna elements is increased. Note that the purpose of the addition antenna element A5' is to provide an approximately 180 degree phase reversal for the lowest frequency electromagnetic radiation output from the antenna element A5, as represented by circular directional arrows 904 and 905.

Figure 10:
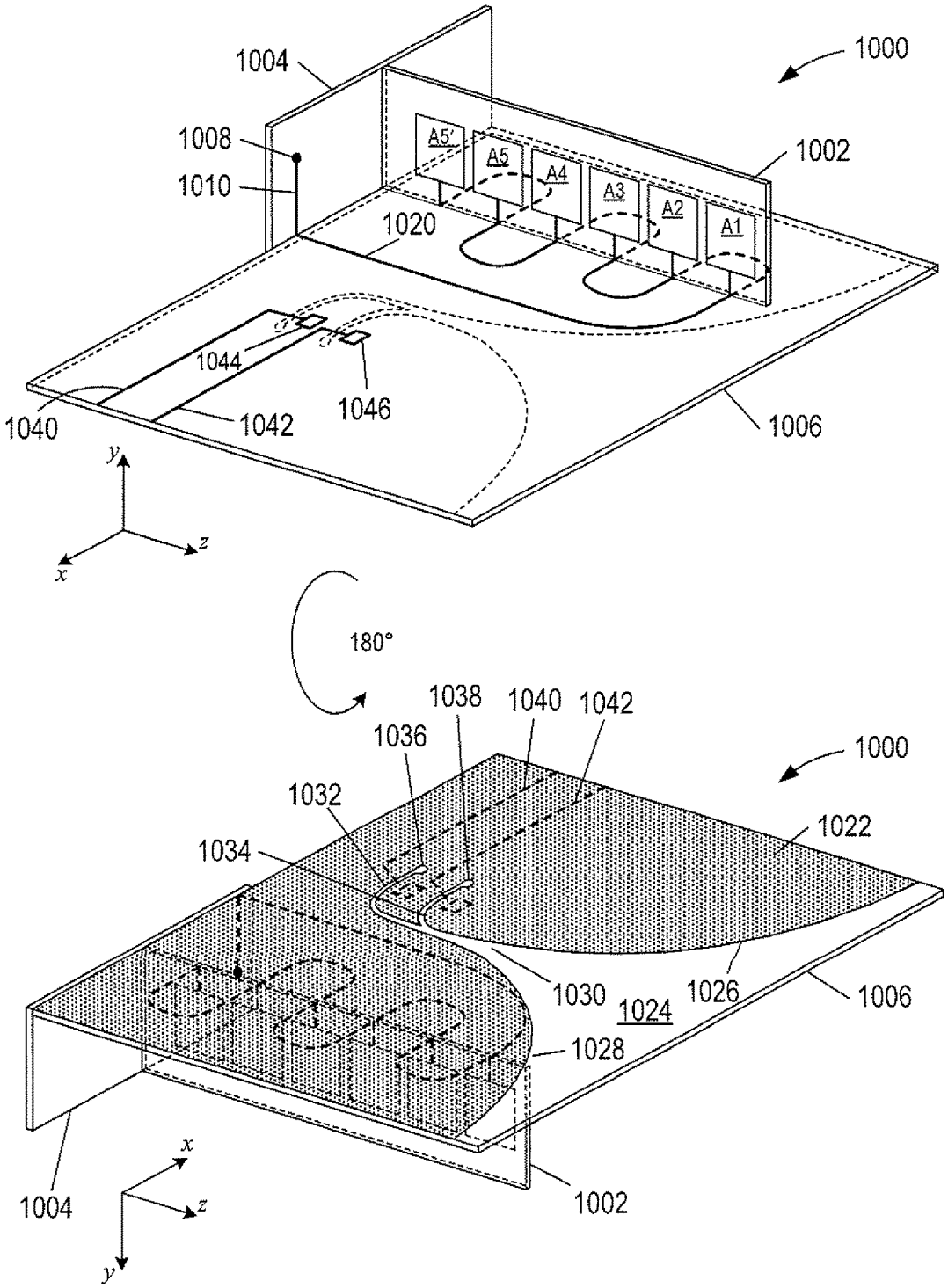
FIG. 10 shows two different views of an example polarization diversity antenna.

FIG. 10 show two different views of an example polarization diversity antenna 1000. The antenna 1000 includes an antenna-array element 1002 with the same antenna elements A1, A2, A3, A4, A5, and A5', a backboard 1004, and a baseboard 1006. The boards 1002, 1004, and 1006 are assemble to form the antenna 1000 with the planes of the boards 1002, 1004, and 1006 oriented at nearly right angles to one another. In this example, the antenna includes an input port 1008 and backboard-feed line 1010 located on a surface of the backboard 1004. The backboard-feed line 1010 is connected to a baseboard-feed line 1012 located on a first surface of the baseboard 1006. As shown in FIG. 10, the boards 1002, 1004, and 1006 form a polarization diversity antenna that operates in the same manner as the antenna 100 described above.

FIG. 10 also shows the antenna 1000 rotated by 180 degrees to reveal a broadband notch antenna formed on an opposing second surface of the baseboard 1006. The notch antenna is formed from a thin conductive layer 1022 represented by shading. The conductive layer 1022 is formed with a horn- or trumpet-shaped notched region 1024 that exposes the second surface of the baseboard 1006 between two curved edges 1026 and 1028 of the layer 106. The notched region 1024 between the curved edges 1026 and 1028 is called an "antenna aperture" that tapers to a central channel 1030 called the "throat." In this particular example, the throat 1030 includes two channels 1032 and 1034 that terminate with corresponding open circle-shaped regions 1036 and 1038 that form capacitors. The notch antenna is also formed with feed lines 1040 and 1042 that terminate to corresponding inductors 1044 and 1046. The inductors 1044 and 1046 may be conductive pads or serpentine meander lines. Note that each inductor does not overlap a capacitor or a channel formed in the conductive layer 1022 and that the feed lines 1040 and 1042 printed on the first surface of the baseboard 1006 cross the channels formed in the conductive layer 1022 disposed on the first surface as approximately 90 degrees. The notch antenna is able to interact with electromagnetic polarization components in the xz-plane.

Implementations are not intended to be simply limited to the descriptions above. Modifications within the spirit of the disclosure will be apparent to those skilled in the art. For example, the throat 1030 of the antenna aperture 1024 may branch into more than two channels that terminate with circle-shaped regions to form capacitors and include two or more corresponding feed lines that terminate with corresponding inductors. In other implementations, the backboards 106 and 1004 may be composed of a conductive material in order to increase electromagnetic radiation reflection. In other implements, the antenna elements may be located on opposing surfaces of the antenna-array board provided the antenna elements do not overlap. For example, in FIG. 1, the antenna elements A1, A3, and A5 may be located on a first surface of the antenna-array board 102 and the antenna elements A2, A4, and A5' may be located on a second opposing surface of the antenna-array board 102 with the antenna elements A2, A4, and A5' not overlapping the antenna elements A1, A3, and A5. Although the boards of the antennas are described above, and shown in the figures, as being orthogonal to another, in still other implementations, the planes of the boards may not be orthogonal to one another. The antenna-array board and baseboard are not limited to rectangular shapes as shown in the figures above. The antenna-array board and based may be shaped to fit within a variety of different spaces of land-based and mobile devices. For example, the planar dimensions of the antenna-array board and baseboard may be angled or otherwise shaped to fit within a wing of an aircraft, a missile, or any mobile device.

It is appreciated that the previous description of the disclosed embodiments is provided to enable a person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. An antenna comprising:

a baseboard with a baseboard-feed line that includes a serpentine meander-line portion; and an antenna-array board with two or more antenna elements, each antenna element having an associated frequency, the two or more antenna elements arranged in a series on the antenna-array board, the antenna-array board attached to the baseboard with the serpentine meander-line portion located between an edge of the antenna-array board and the baseboard and each antenna element connected to the serpentine meander-line portion via an antenna-feed line located on the antenna-array board, wherein a length of each segment of the serpentine meander-line portion between two antenna-feed lines of adjacent antenna elements is inversely proportional to a larger of the two frequencies associated with the two adjacent antenna elements and two adjacent antenna elements with one of the two antenna elements connected to an end of the serpentine meander-line portion have the same associated frequency.

2. The antenna of claim 1 further comprising a backboard attached at approximately right angles to the baseboard and the antenna board.

3. The antenna of claim 2, wherein each antenna element interacts with a different frequency band of the frequency spectrum; and the antenna elements arranged according to associated frequencies with the antenna element associated with the lowest frequency of interaction located closest to the backboard and the antenna element associated with the highest frequency of interaction located farthest from the backboard.

4. The antenna of claim 1, wherein the antenna elements further comprise meander-line antenna elements.

5. The antenna of claim 1, wherein the antenna elements each interact with a different frequency band of the radio spectrum.

6. The antenna of claim 1, wherein each antenna element interacts with a different frequency band of the frequency spectrum; and the antenna elements arranged according to associated frequencies with the antenna element associated with the lowest frequency of interaction located at one end of the antenna element series and the antenna element associated with the highest frequency of interaction located at the opposite end of the antenna element series.

7. The antenna of claim 1, wherein each segment of the meander-feel line that connects adjacent antenna elements that interact with different wavelengths of electromagnetic radiation is approximately equal to one half a shortest wavelength of the two different wavelengths.

8. The antenna of claim 1, wherein the antenna elements include adjacent elements that interact with a particular frequency.

9. The antenna of claim 1, wherein the antenna elements in the series are arranged so that for each pair of adjacent antenna elements, the antenna element associated with a lower frequency of electromagnetic radiation interaction generates phase reversal in the antenna element associated with a higher frequency of electromagnetic radiation.

10. An antenna comprising:

a baseboard with a baseboard-feed line that includes a serpentine meander-line portion located on a first surface of the baseboard and a notch antenna formed on an opposing second surface of the baseboard; and an antenna-array board with two or more antenna elements, each antenna element having an associated frequency, the two or more antenna elements arranged in a series on the antenna-array board, the antenna-array board attached to the baseboard with the serpentine meander-line portion located between an edge of the antenna-array board and the baseboard and each antenna element connected to the serpentine meander-line portion via an antenna-feed line located on the antenna-array board, wherein a length of each segment of the serpentine meander-line portion between two antenna-feed lines of adjacent antenna elements is inversely proportional to a larger of the two frequencies associated the two adjacent antenna elements and two adjacent antenna elements with one of the two antenna elements connected to an end of the serpentine meander-line portion have the same associated frequency.

11. The antenna of claim 10, wherein the notch antenna further comprises a conductive layer disposed on the second surface, the conductive layer having a notch region that exposes the dielectric plate between edges of the conductive layer;

a central channel and includes two or more channels that branch from the central channel;

a capacitor located at the end of each channel; and an inductor disposed on the first surface of the baseboard not opposite the channels or the capacitors.

12. The antenna of claim 11, wherein each inductor is connected to a feed line disposed on the first surface.

13. The antenna of claim 10 further comprising a backboard attached at approximately right angles to the baseboard and the antenna board.

14. The antenna of claim 13, wherein each antenna element interacts with a different frequency band of the frequency spectrum; and the antenna elements arranged according to associated frequencies with the antenna element associated with the lowest frequency of interaction located closest to the backboard and the antenna element associated with the highest frequency of interaction located farthest from the backboard.

15. The antenna of claim 10, wherein the antenna elements further comprise meander-line antenna elements.

16. The antenna of claim 10, wherein the antenna elements each interact with a different frequency band of the radio spectrum.

17. The antenna of claim 10, wherein each antenna element interacts with a different frequency band of the frequency spectrum; and the antenna elements arranged according to associated frequencies with the antenna element associated with the lowest frequency of interaction located at one end of the antenna element series and the antenna element associated with the highest frequency of interaction located at the opposite end of the antenna element series.

18. The antenna of claim 10, wherein each segment of the meander-feel line that connects adjacent antenna elements that interact with different wavelengths of electromagnetic radiation is approximately equal to one half a shortest wavelength of the two different wavelengths.

19. The antenna of claim 10, wherein the antenna elements include adjacent elements that interact with a particular frequency.

20. The antenna of claim 10, wherein the antenna elements in the series are arranged so that for each pair of adjacent antenna elements, the antenna element associated with a lower frequency of electromagnetic radiation interaction generates phase reversal in the antenna element associated with a higher frequency of electromagnetic radiation.

* * * * *